US012553193B2

(12) United States Patent
Vachon

(10) Patent No.: US 12,553,193 B2
(45) Date of Patent: Feb. 17, 2026

(54) SELF-COOLING ARTIFICIAL TURF SYSTEM WITH WATER RETENTION

(71) Applicant: SAFEPLAY LLC, Cedar Park, TX (US)

(72) Inventor: Frederic Vachon, Montreal (CA)

(73) Assignee: TENCATE GRASS HOLDING BV, Nijverdal (NL)

( * ) Notice: Subject to any disclaimer, the term of this patent is extended or adjusted under 35 U.S.C. 154(b) by 719 days.

(21) Appl. No.: 17/758,149

(22) PCT Filed: Apr. 27, 2021

(86) PCT No.: PCT/IB2021/053474
§ 371 (c)(1),
(2) Date: Jun. 29, 2022

(87) PCT Pub. No.: WO2021/229339
PCT Pub. Date: Nov. 18, 2021

(65) Prior Publication Data

US 2023/0023506 A1 Jan. 26, 2023

Related U.S. Application Data

(60) Provisional application No. 63/023,386, filed on May 12, 2020.

(51) Int. Cl.
*E01C 13/08* (2006.01)
*E01C 13/02* (2006.01)

(52) U.S. Cl.
CPC ..... *E01C 13/08* (2013.01); *E01C 13/02* (2013.01)

(58) Field of Classification Search
CPC ..... E01C 13/02; E01C 13/08; E01C 13/045; E01C 13/065; E01C 13/083
(Continued)

(56) References Cited

U.S. PATENT DOCUMENTS 7,645,501 B2 1/2010 Sawyer et al.
7,662,468 B2 2/2010 Bainbridge
(Continued)

FOREIGN PATENT DOCUMENTS

KR 20110000261 U 1/2011
WO 2019094662 A1 5/2019
WO 2020092762 A1 5/2020

OTHER PUBLICATIONS

International Search Report for International Application No. PCT/IB2021/053474 mailed Nov. 18, 2021.
(Continued)

*Primary Examiner* — Eugene L Kim
(74) *Attorney, Agent, or Firm* — Perilla Knox & Hildebrandt LLP; Kenneth A. Knox

(57) ABSTRACT

A self-cooling artificial turf system for water retention and evaporation is described. The system includes a synthetic surface comprising an elastic sub-layer having shock absorbing pads, or shock pads, configured to interlock to one another. Individual ones of the shock pads comprise a top surface and a moisture accumulation region defined by an edge having a height taller than the top surface. Synthetic fibers are positioned above the synthetic surface that are in fluid connection with the at least one moisture accumulation region such that the synthetic fibers are able to wick moisture from the at least one moisture accumulation region when the moisture is present. At least a portion of the synthetic fibers are hydrophilic such that the synthetic fibers wick the moisture as it is expelled from the at least one moisture accumulation region, thereby cooling at least the portion of the synthetic surface.

16 Claims, 4 Drawing Sheets

(58) Field of Classification Search
USPC ..... 472/92
See application file for complete search history.

(56) References Cited

U.S. PATENT DOCUMENTS

| | | | |
|---|---|---|---|
| 7,785,692 | B1 | 8/2010 | Siegel |
| D637,318 | S | 5/2011 | Sawyer et al. |
| D645,169 | S | 9/2011 | Runkles |
| 8,236,392 | B2 | 8/2012 | Sawyer et al. |
| 8,353,640 | B2 | 1/2013 | Sawyer |
| 8,356,447 | B2 | 1/2013 | Lach |
| 8,568,840 | B2 | 10/2013 | Sawyer et al. |
| 8,597,754 | B2 | 12/2013 | Sawyer et al. |
| 8,603,601 | B2 | 12/2013 | Sawyer et al. |
| 8,662,787 | B2 | 3/2014 | Sawyer et al. |
| 8,668,403 | B2 | 3/2014 | Sawyer |
| 8,858,349 | B2 | 10/2014 | Vachon |
| 8,967,906 | B2 | 3/2015 | Sawyer |
| 9,394,651 | B2 | 7/2016 | Sawyer |
| 9,771,692 | B2 | 9/2017 | Sawyer et al. |
| 9,790,646 | B2 | 10/2017 | Sawyer et al. |
| D866,800 | S | 11/2019 | Runkles et al. |
| D874,682 | S | 2/2020 | Vachon |
| D886,333 | S | 6/2020 | Vachon |
| 10,982,395 | B2 | 4/2021 | Sawyer et al. |
| 11,047,094 | B2 | 6/2021 | Vachon |
| 2003/0082005 | A1 | 5/2003 | Scott |
| 2005/0042394 | A1 | 2/2005 | Sawyer et al. |
| 2010/0040808 | A1 | 2/2010 | Van Der Gaag et al. |
| 2010/0104778 | A1 | 4/2010 | Wise |
| 2011/0173901 | A1 | 7/2011 | Runkles et al. |
| 2013/0102403 | A1 | 4/2013 | Vachon |
| 2015/0176225 | A1 | 6/2015 | Sawyer |
| 2016/0265170 | A1 | 9/2016 | Vachon et al. |
| 2018/0237998 | A1 | 8/2018 | Vachon |
| 2019/0203425 | A1* | 7/2019 | Sawyer ..... E01C 13/083 |
| 2019/0376241 | A1 | 12/2019 | Vachon |
| 2020/0002897 | A1 | 1/2020 | Vachon |
| 2020/0063379 | A1 | 2/2020 | Sawyer et al. |
| 2020/0070038 | A1 | 3/2020 | Vachon |
| 2020/0181854 | A1 | 6/2020 | Vachon |
| 2020/0181855 | A1 | 6/2020 | Vachon |

OTHER PUBLICATIONS

Written Opinion for International Application No. PCT/IB2021/053474 mailed Nov. 18, 2021.

Supplementary European Search Report for Patent Application No. 21803142.5 of Sep. 16, 2024.

* cited by examiner

SELF-COOLING ARTIFICIAL TURF SYSTEM WITH WATER RETENTION

CROSS-REFERENCE TO RELATED APPLICATION

This application is a national phase application under 35 U.S.C. § 371 of International Application No. PCT/IB2021/053474 filed Apr. 27, 2021, which claims the benefit of and priority to U.S. Provisional Application No. 63/023,386 entitled "SELF-COOLING ARTIFICIAL TURF SYSTEM WITH WATER RETENTION" filed May 12, 2020, the contents of both which being incorporated by reference in their entireties herein.

BACKGROUND

Synthetic surfaces, sometimes referred to as synthetic turf or artificial turf, can replace grass to lower maintenance costs associated with playing fields, lawns, playgrounds, and similar areas. While there are many advantages to synthetic surfaces, one drawback is that, due to the materials of its formulation, a synthetic surface can get much hotter than a natural surface when heated by the sun.

TECHNICAL FIELD

The present disclosure relates to layers for athletic fields and, in particular, describes a self-cooling artificial turf system capable of moisture retention and evaporation.

BRIEF SUMMARY OF THE INVENTION

Various embodiments for a shock pad that may be combined with other similar shock pads to form an elastic sub-layer of an athletic field, or other surface, are disclosed. A system may include a synthetic surface comprising an elastic sub-layer, where the elastic sub-layer comprises one or more shock absorbing pads, referred to herein as shock pads, that are configured to interlock to one another. Individual ones of the shock pads may include an edge having a height taller than a top surface of a respective one of the shock pads, thereby defining a moisture accumulation region. Synthetic fibers may be positioned above the synthetic surface such that the synthetic fibers wick moisture, such as water, from the moisture accumulation region. At least a portion of the synthetic fibers may be hydrophilic such that the synthetic fibers wick moisture as it is expelled from the moisture accumulation region, thereby cooling at least the portion of the synthetic surface.

In a further embodiment, a system includes a synthetic surface comprising an elastic sub-layer, where the elastic sub-layer comprises one or more shock pads configured to interlock to one another. Individual ones of the shock pads include an edge having a height taller than a top surface that defines at least one moisture accumulation region. The system further includes a layer of synthetic fibers positioned above the synthetic surface and an infill material positioned on or near the synthetic fibers. At least one component of the infill material is hydrophilic such that the infill wicks moisture as it is expelled from the at least one moisture accumulation region, thereby cooling at least the portion of the synthetic surface. The infill material may include rubber infill, ethylene-propylene-diene monomer (EPDM) rubber infill, sand infill, cork infill, mulch infill, coconut shell infill, thermoplastic elastomer (TPE) infill, wood chips, wood infill, textured fibbers, thatch fibers, and/or a combination thereof.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
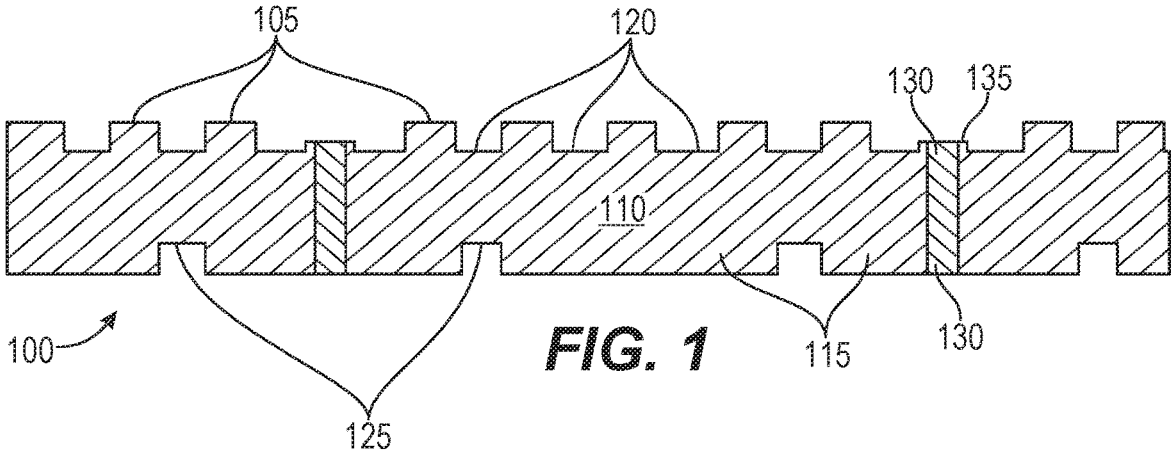
FIG. 1 is a cross-sectional view of a shock pad without water accumulation in accordance with various embodiments described herein.

The present disclosure relates to heat management for synthetic fields and surfaces. Synthetic surfaces are often installed as playing fields for sports (e.g., football, soccer, baseball, or field hockey) or leisure surfacing (e.g., playgrounds or landscaping). The surface of synthetic fields can appear similar to grass, with various fiber length depending on the application. Frequently spanning a large area, a drawback is that the synthetic surface can get hot in the sun.

The synthetic fibers of the surface may include polymers, such as polyethylene, polypropylene, nylon, a mix of polymer and polyester, which retain heat and reach high temperatures from warm weather and sunlight, which can be a drawback to synthetic surfaces. Notably, sports fields and other surfaces that incorporate synthetic fibers and receive direct sunlight can get up to approximately 40-70 degrees hotter than surrounding air temperatures. For instance, on warmer days, synthetic turf fields can heat to temperatures from 120 to 180° Fahrenheit (48 to 82° Celsius). As a result, playing on synthetic turf having such high temperatures can result in melting shoes, blistered hands or feet, increased risk of dehydration or heatstroke, as well as damage to the artificial turf. Accordingly, the heat retention in synthetic surfaces are problematic.

Manufacturers attempt to solve the heat retention problem in synthetic surfaces using copolymers for synthetic fibers, or including additives in the fiber composition. Alternatively, infill material is added to an installation that is composed of a material that retains less heat. For instance, infill materials having a lighter color or formed of organic materials have been used, such as shredded coconut shells, wood chips, and the like.

Also, installations have included an external watering spray system, configured similar to a traditional sprinkler system that allows watering the field before a game. However, water evaporates quickly and the benefits of the water-cooling effect wears off rapidly. In any event, the standard procedure today for cooling off a synthetic field includes spraying the field with water, which results in an inefficient usage of water and oversaturation of the synthetic surface, making the field difficult or less than ideal to play on. All of these attempts to reduce the temperature of the playing surface have had minimal effect.

Accordingly, various embodiments for a system that can accumulate water from the rain or irrigation are described herein to control a temperature of at least a portion of a synthetic surface (e.g., landscaping or athletic playing field) and maintain a suitable temperature for use thereof. As such, a supply of water or other fluid may be provided to synthetic turf fibers, where such fibers may include those configured to absorb and wick moisture in such a way to provide a passive and/or active cooling effect on the fiber and reduce a temperature of the fiber.

For instance, in various embodiments, a synthetic turf system is described that includes an elastic sub-layer (also referred to as a deflection layer, an impact layer, and/or a shock pad layer) configured to accumulate and retain moisture, and control the evaporation thereof at a predetermined rate. The elastic sub-layer may be positioned below a fiber layer of the synthetic surface. A synthetic surface, such as an artificial field, may be tufted or woven. The system may provide a regulated flow of water below the turf layer to maintain a moisture level in a range of suitable moisture levels in the fibers, thereby constantly cooling the field.

With an evaporating process described herein, less moisture may be used as compared to a traditional sprinkler system that applies water to a top of a surface of the synthetic field, conserving water while maintaining a cool surface. In some embodiments, a rate at which moisture is accumulated under the turf can be controlled to be substantially similar to a rate at which fibers of the synthetic surface are able to wick moisture without being oversaturated. Thus, the fibers of the synthetic surface may be continuously dampened while excess moisture is not added to the synthetic surface or playing field. As a result of the wicking of the moisture from the bottom, passive evaporative cooling is achieved in combination with active cooling (e.g., cooling achieved by the application of water being cooler than a temperature of the synthetic turf).

The synthetic surface system may include synthetic turf comprising synthetic fibers made from polymers, such as polyethylene, polypropylene, nylon, polyester, or other material as may be appreciated. In some examples, a face fiber composed of a soft and durable nylon fiber may be used. For example, as nylon holds water, the yarn can drip water stored below to be absorbed by the nylon thatch and nylon face fiber, thereby cooling the fiber and reducing the temperature of the fibers and the field. In some examples, an infill may be included.

In some embodiments, the face fiber may include heat and/or solar reflective properties. For instance, in some embodiments, an outer surface of the face fiber may include a coating of a polymer or other material that causes the face fiber to reflect heat and/or sunlight. Also, in some embodiments, an outer surface of the face fiber may include a color that provides heat and/or reflective properties.

In some embodiments, the fibers are hydrophilic and are configured to wick moisture from the elastic sub-layer (shock pad) below. Infill material may be positioned on top and/or in between the fibers, where the infill material may include rubber infill, ethylene-propylene-diene (EPDM) rubber infill, sand infill, cork infill, mulch infill, coconut shell infill, thermoplastic elastomer (TPE) infill, hydrophilic synthetic infill textured fibbers, thatch fibers or a combination thereof or any material that can absorb a certain amount of moisture.

The infill material may act as a ballast to the synthetic surface and/or include a grip material for players to maintain proper traction on the synthetic surface. In additional embodiments, the infill material may include a material that holds moisture such as vermiculite. In some applications for non-infill turf systems, the thatch fibers may be used in place of an infill material.

The synthetic surface may include a synthetic athletic field surface, where the synthetic surface may include a plurality of face fibers of a first length attached in rows to the first sheet in an orientation substantially normal to the first surface of the first sheet, a plurality of thatch fibers of a second length attached to the first sheet and disposed between the rows of the face fibers, a second sheet with a first surface, wherein the first surface of the second sheet is attached to a second surface of the first sheet.

Accordingly, various embodiments for a shock pad that may be combined with other similar shock pads to form an elastic sub-layer of an athletic field, or other surface, are disclosed. A system may include a synthetic surface comprising an elastic sub-layer, where the elastic sub-layer comprises a plurality of shock pads configured to interlock to one another. Individual ones of the shock pads comprise an edge having a height taller than a top surface that defines a moisture accumulation region. Synthetic fibers may be positioned above the synthetic surface such that the synthetic fibers wick moisture from the moisture accumulation region, where at least a portion of the synthetic fibers are hydrophilic such that the plurality of synthetic fibers wick the moisture as it is expelled from the moisture accumulation region, thereby cooling at least the portion of the synthetic surface.

In a further embodiment, a system includes a synthetic surface comprising an elastic sub-layer, where the elastic sub-layer comprises a plurality of shock pads configured to interlock to one another. Individual ones of the shock pads comprise an edge having a height taller than a top surface that defines at least one moisture accumulation region. The system further includes a plurality of synthetic fibers positioned above the synthetic surface and an infill material positioned on or near the synthetic fibers. At least one component of the infill material is hydrophilic such that the infill wicks moisture as it is expelled from the at least one moisture accumulation region, thereby cooling at least the portion of the synthetic surface. The infill material may include rubber infill, ethylene-propylene-diene (EPDM) rubber infill, sand infill, cork infill, mulch infill, coconut shell infill, thermoplastic elastomer (TPE) infill, wood chips, wood infill, textured fibbers, thatch fibers, and/or a combination thereof.

Turning now to the drawings, FIG. 1 is a cross-sectional view of a shock absorbing pad, also referred to herein as a shock pad 100, and is shown according to various embodiments without any moisture accumulation. Additionally, FIG. 2 is a cross-sectional view of the shock pad 100 of FIG. 1 having water accumulation, and FIG. 3 is a cross-sectional view of the shock pad 100 of FIG. 1 with saturated water accumulation and water evacuation, as will be described.

Figure 2:
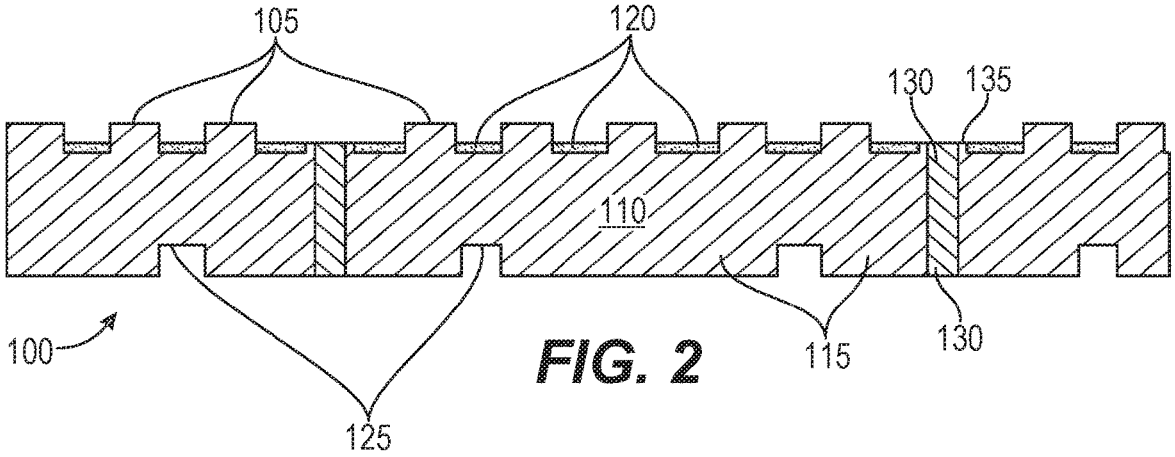
FIG. 2 is a cross-sectional view of the shock pad of FIG. 1 with water accumulation in accordance with various embodiments described herein.
Figure 3:
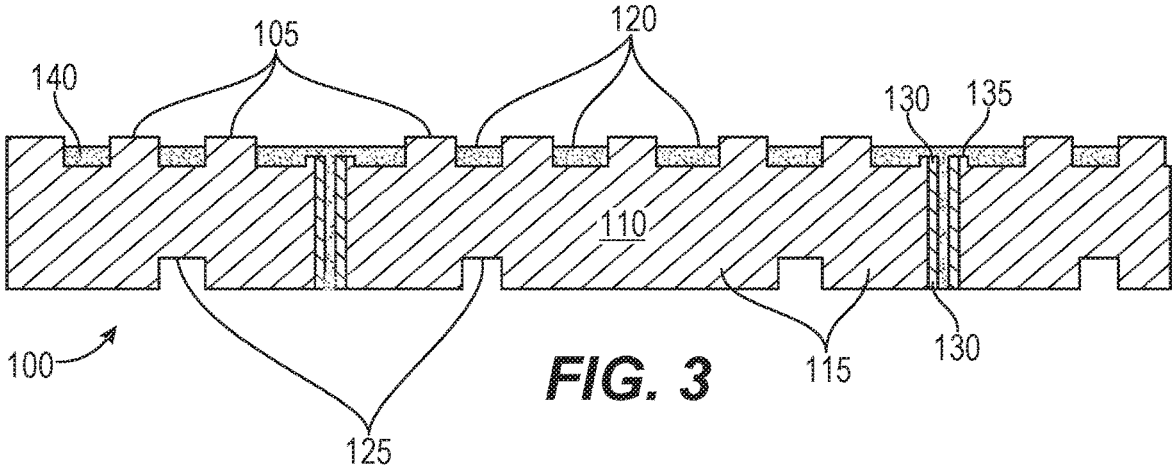
FIG. 3 is a cross-sectional view of the shock pad of FIG. 1 with saturated water accumulation and water evacuation in accordance with various embodiments described herein.

Referring to FIGS. 1-3 collectively, according to various embodiments, the shock pad 100 may include top protrusions 105 that are positioned on a top surface of a body 110 of the shock pad 100, and/or bottom protrusions 115 that are positioned on a bottom surface of the body 110 of the shock pad 100. The top protrusions 105 include edges raised from the top surface of the body 110 that define top surface moisture channels 120. For instance, accumulated water or other liquid may flow in the top surface moisture channels 120 between the top protrusions 105. Similarly, the bottom protrusions 115 include edges projecting downward from the bottom surface of the body 110 that define bottom surface moisture channels 125. Accumulated water or other liquid may flow in the bottom surface moisture channels 125 between the bottom protrusions 115.

The shock pad 100 further includes one or more drainage holes 130. In various embodiments, the drainage holes 130 connect the top surface of the shock pad 100 (e.g., top surface moisture channels 120) with a bottom protrusion 115, which includes a downward projecting portion on a bottom surface of the body 110 of the shock pad 100. The drainage hole 130, in some embodiments, does not align a top surface moisture channel 120 with a bottom surface moisture channel 125. For instance, the drainage holes 130 are not within or directly adjacent to a top surface moisture channel 120. Instead, the drainage holes 130 are nested within a raised edge 135 such that the drainage holes 130 connect the top surface of the body 110 with a respective one of the bottom protrusions 115. The raised edge 135 may include a circular-, square-, rectangular-shaped raised edge so long as the ends of the shape touch one another, not permitting water to seep through in a location other than a top of the raised edge 135. In alternative embodiments, the drainage holes 130 may connect the top surface moisture channels 120 with the bottom surface moisture channels 125 in certain situations, as will be described.

As shown in FIGS. 2 and 3, the raised edge 135 permits a certain amount of moisture to be retained on a top surface of the body 110 of the shock pad 100. Notably, moisture may evacuate through the drainage holes 130 when a moisture level of the top surface of the body 110 is higher than a hole or slope perimeter lip (e.g., the raised edge 135). Otherwise, a predetermined amount of moisture is retained on a top surface of the body 110 of the shock pad 100.

Figure 4:
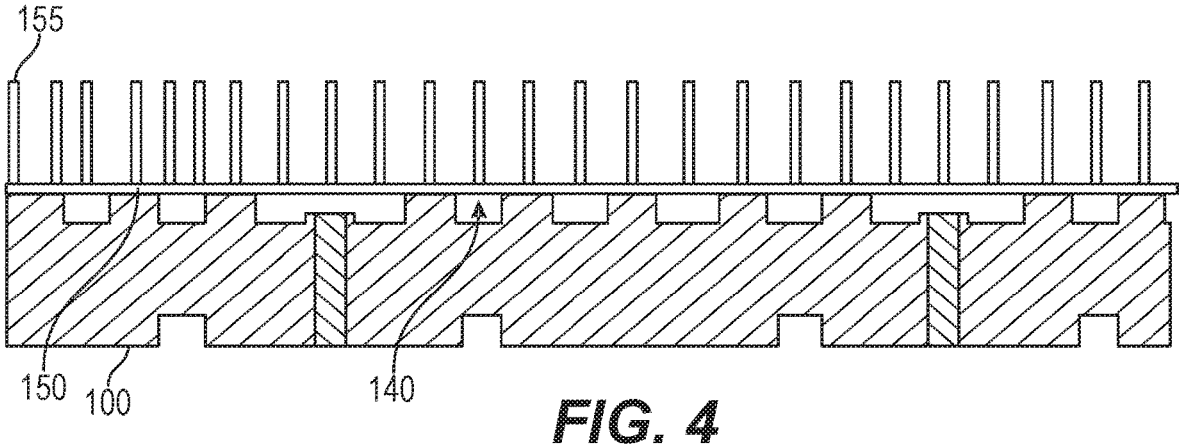
FIG. 4 is a synthetic fiber on top of the shock pad for use in a synthetic field that comprises a hydrophilic fiber in accordance with various embodiments described herein.

Referring next to FIG. 4, a synthetic field 150, forming a synthetic field layer, is shown positioned on top of the shock pad 100. The synthetic field 150 may be directly on top of the shock pad 100, or other intermediary layers may be positioned between the synthetic field and the shock pad 100. The synthetic field 150 may include synthetic fibers 155, such as face fibers having varying lengths, thatch fibers, or a combination thereof. In some embodiments, one or more of the synthetic fibers 155 include a hydrophilic fiber which may be in fluid connection with a moisture accumulation region 140. To this end, the synthetic fibers 155 may wick moisture from one or more of the moisture accumulation regions 140.

For instance, the synthetic fibers 155 may include hydrophilic fibers such that the synthetic fibers 155 wick the moisture as it is expelled from the at least one moisture accumulation region 140, thereby cooling at least the portion of the synthetic field 150 using evaporative cooling, which is a passive type of cooling. As such, the synthetic fibers 155 may be described as being in "fluid connection" with the moisture accumulation region 140 as moisture, such as water, travels from the moisture accumulation region 140 through the synthetic fiber 155 where it is evaporated, causing a cooling effect.

Figure 5:
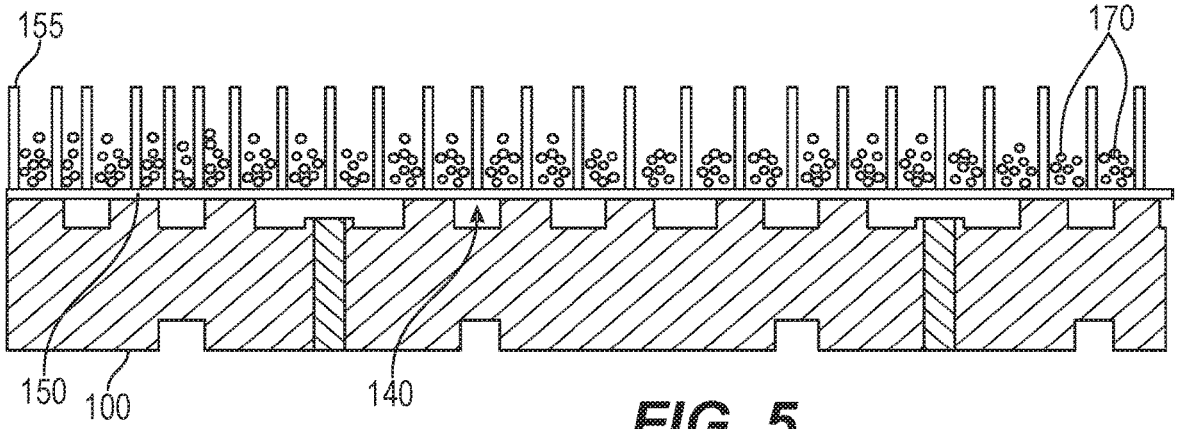
FIG. 5 is a synthetic fiber system and infill top installed on top of the shock pad that comprises at least hydrophilic fiber or hydrophilic infill in accordance with various embodiments described herein.

Turning now to FIG. 5, a synthetic fiber system is shown including the synthetic field 150 and infill 170 installed on top of the shock pad 100, for instance, on, on top of, or between the synthetic fibers 155. Again, the synthetic fibers 155 may include at least one hydrophilic fiber. Additionally, the infill 170 may be a hydrophilic infill in accordance with various embodiments described herein.

Figure 6:
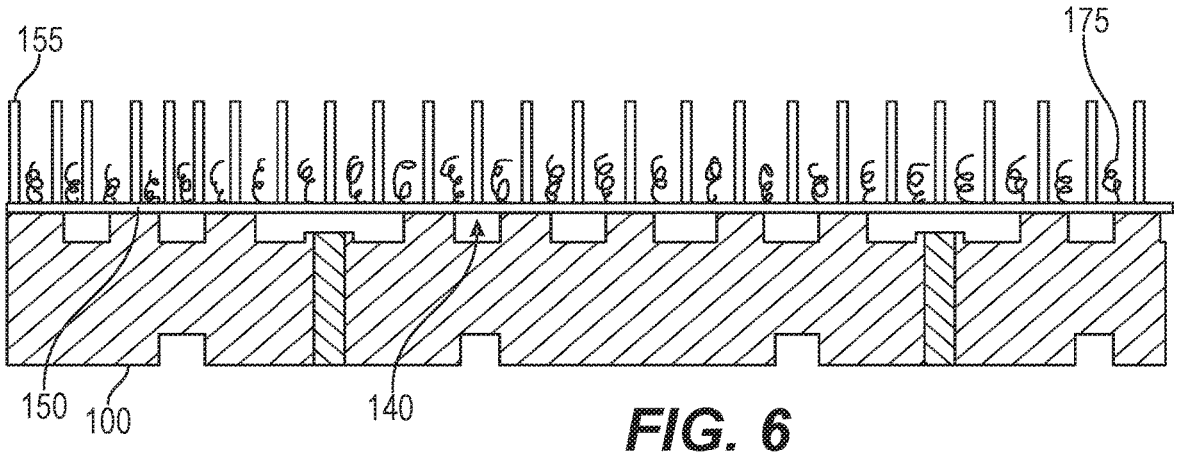
FIG. 6 is a synthetic fiber system on top of the shock pad that comprises at least one hydrophilic straight fiber and/or hydrophilic texturized fiber in accordance with various embodiments described herein.

Moving along to FIG. 6, a synthetic fiber system is shown including the synthetic field 150 and on top of the shock pad 100. The synthetic fiber system may include at least one hydrophilic straight fiber (e.g., synthetic fiber 155), and/or a least one hydrophilic texturized fiber 175 in accordance with various embodiments described herein.

Figure 7:
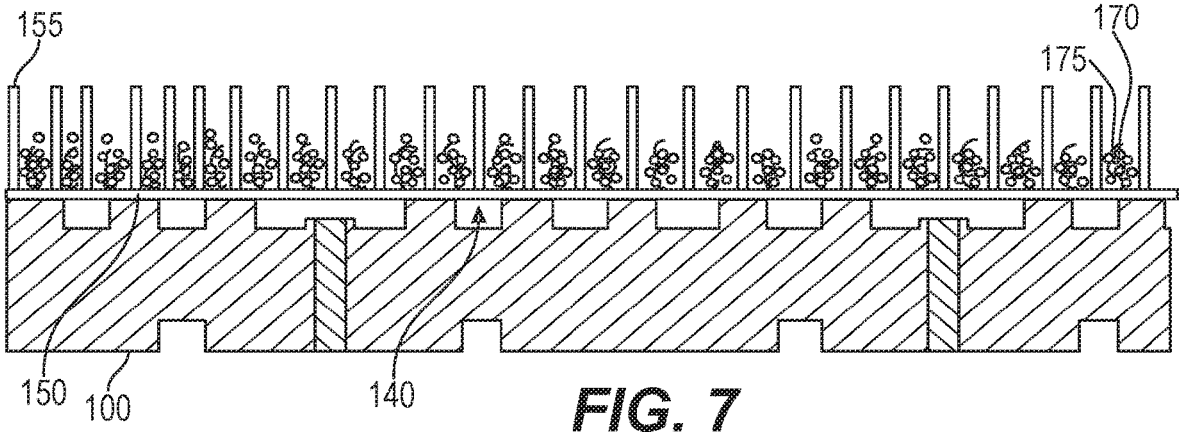
FIG. 7 is a synthetic fiber system on top of the shock pad that comprises at least one hydrophilic straight fiber and/or hydrophilic texturized fiber and/or hydrophilic infill in accordance with various embodiments described herein.

Referring now to FIG. 7, a synthetic fiber system is shown being positioned on top of the shock pad 100. The synthetic fiber system includes at least one hydrophilic straight fiber 155, and/or hydrophilic texturized fiber 175, and/or hydrophilic infill 170 in accordance with various embodiments described herein.

Figure 8:
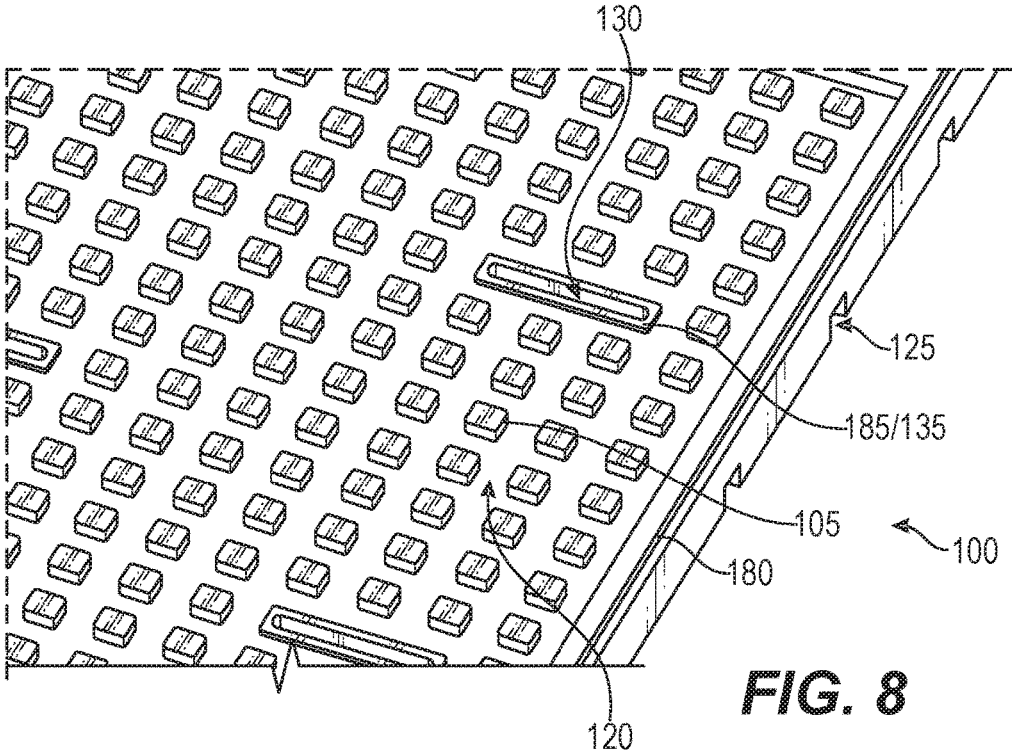
FIG. 8 is a three-dimensional view of the shock pad with perimeter lips and a perimeter around each of the water drainage holes in accordance with various embodiments described herein.

Turning next to FIG. 8, a three-dimensional view of the shock pad 100 is shown. The shock pad 100 may include perimeter lips 180 and a drainage hole perimeter 185 (having a raised edge 135) around each drainage hole 130 in accordance with various embodiments described herein. As shown in FIG. 8, the drainage hole perimeter 185 and the drainage hole 130 are substantially rectangular in shape; however, in alternative embodiments the drainage hole perimeter 185 and the drainage hole 130 may be substantially circular-shaped, square-shaped, star-shaped, or assume another suitable shape. In FIG. 8, the drainage hole 130 is not positioned in any top surface moisture channels 120, but instead replaces three of the top protrusions 105. The shock pads 100 may connect to one another using male and female projections, respectively, as it known in the art.

In various embodiments, the shock pad 100 may be molded, for instance, using polypropylene or similar material(s). For instance, in some embodiments, the shock pad 100 may be formed of open-cell or closed-cell polypropylene beads. The polypropylene may have a density of approximately one to three pounds per cubic foot molded into the shock pad 100 with a density of between about one to three pounds per cubic foot, in some embodiments. The disclosure is not intended to be limited to these ranges, and other materials and ranges may be employed.

The various exemplary embodiments of the present invention include a self-cooling artificial turf system. In some embodiments, the self-cooling artificial turf system includes a foundation (not shown) along with the synthetic fibers 155 (e.g., grass-like filaments), and the shock pad 100 described herein. The foundation may include one or more of bare ground, stone, gravel, sand, asphalt, cement, and rubber. The synthetic fibers 155 may be attached to a backing layer such that the backing layer is substantially adjacent to the topside of a foundation and such that the synthetic fibers 155 extend substantially upward from the backing layer.

It should be noted that, when employed in the present disclosure, the terms "includes," "including," "comprises," "comprising," and other derivatives from the root terms "include" and "comprise" are intended to be open-ended terms that specify the presence of any stated features, elements, integers, steps, or components, and are not intended to preclude the presence or addition of one or more other features, elements, integers, steps, components, or groups thereof.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y.'"

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by supported claims.

Clause 1. A self-cooling artificial turf system for moisture retention and evaporation, comprising: a synthetic surface comprising an elastic sub-layer, wherein the elastic sub-layer comprises a plurality of shock pads configured to interlock to one another, wherein individual ones of the shock pads comprise a top surface and at least one moisture accumulation region defined by an edge having a height taller than the top surface; and a plurality of synthetic fibers positioned above the synthetic surface in fluid connection with the at least one moisture accumulation region such that the synthetic fibers are configured to wick moisture from the at least one moisture accumulation region when the moisture is present, wherein at least a portion of the synthetic fibers are hydrophilic such that the plurality of synthetic fibers wick the moisture as it is expelled from the at least one moisture accumulation region, thereby cooling at least the portion of the synthetic surface.

Clause 2. The system of clause 1, wherein the respective one of the plurality of shock pads further comprises: a bottom surface; a plurality of bottom protrusions on the bottom surface; a plurality of top protrusions defining top surface moisture channels on the top surface; and a plurality of drainage holes connecting at least one of the top surface moisture channels to a respective one of the bottom protrusions.

Clause 3. The system of any of clauses 1-2, wherein at least one of the drainage holes is nested within a raised edge on the top surface that prohibits moisture from draining from the at least one moisture accumulation region until a moisture level of the moisture rises higher than the raised edge.

Clause 4. The system of any of clauses 1-3, further comprising infill material positioned in between the plurality of synthetic fibers, the infill material selected from a group consisting of: rubber infill, ethylene-propylene-diene (EPDM) rubber infill, sand infill, cork infill, mulch infill, coconut shell infill, thermoplastic elastomer (TPE) infill, wood chips, wood infill, textured fibbers, thatch fibers, and any combination thereof.

Clause 5. The system of any of clauses 1-4, wherein the synthetic surface comprises a synthetic athletic field surface or a synthetic landscaping surface, and the synthetic fibers comprise a plurality of synthetic grass fibers.

Clause 6. The system of any of clauses 1-5, wherein the synthetic grass fibers comprise: a plurality of face fibers of a first length; and a plurality of thatch fibers of a second length disposed in rows within the face fibers and thatch fibers.

Clause 7. The system of any of clauses 1-6, wherein the individual ones of the shock pads are formed of molded open-cell expanded bead polypropylene.

Clause 8. A method for moisture retention and evaporation, comprising: providing a synthetic surface comprising an elastic sub-layer, wherein the elastic sub-layer comprises a plurality of shock pads configured to interlock to one another, wherein individual ones of the shock pads comprise a top surface and at least one moisture accumulation region defined by an edge having a height taller than the top surface; and positioning a plurality of synthetic fibers above the synthetic surface in fluid connection with the at least one moisture accumulation region such that the synthetic fibers wick moisture from the at least one moisture accumulation region when the moisture is present, wherein at least a portion of the synthetic fibers are hydrophilic such that the plurality of synthetic fibers wick the moisture as it is expelled from the at least one moisture accumulation region, thereby cooling at least the portion of the synthetic surface.

Clause 9. The method of clause 8, wherein the respective one of the plurality of shock pads further comprises: a bottom surface; a plurality of bottom protrusions on the bottom surface; a plurality of top protrusions defining top surface moisture channels on the top surface; and a plurality of drainage holes connecting at least one of the top surface moisture channels to a respective one of the bottom protrusions.

Clause 10. The method of any of clauses 8-9, wherein at least one of the drainage holes is nested within a raised edge on the top surface that prohibits moisture from draining from the at least one moisture accumulation region until a moisture level of the moisture rises higher than the raised edge.

Clause 11. The method of any of clauses 8-10, further comprising infill material positioned in between the plurality of synthetic fibers, the infill material selected from a group consisting of: rubber infill, ethylene-propylene-diene (EPDM) rubber infill, sand infill, cork infill, mulch infill, coconut shell infill, thermoplastic elastomer (TPE) infill, wood chips, wood infill, textured fibbers, thatch fibers, and any combination thereof.

Clause 12. The method of any of clauses 8-11, wherein the synthetic surface comprises a synthetic athletic field surface or a synthetic landscaping surface, and the synthetic fibers comprise a plurality of synthetic grass fibers.

Clause 13. The method of any of clauses 8-12, wherein the synthetic grass fibers comprise: a plurality of face fibers of a first length; and a plurality of thatch fibers of a second length disposed in rows within the face fibers and thatch fibers.

Clause 14. The method of any of clauses 8-13, wherein the individual ones of the shock pads are formed of molded open-cell expanded bead polypropylene.

Clause 15. A self-cooling artificial turf system for moisture retention and evaporation, comprising: a synthetic surface comprising an elastic sub-layer, wherein the elastic sub-layer comprises a plurality of shock pads configured to interlock to one another, wherein individual ones of the shock pads comprise a top surface and at least one moisture accumulation region defined by an edge having a height taller than the top surface; and a plurality of synthetic fibers positioned above the synthetic surface and an infill material positioned on or near the synthetic fibers, the infill material being in fluid connection with the at least one moisture accumulation region, wherein the infill material is hydrophilic such that the infill wicks moisture as it is expelled from the at least one moisture accumulation region, thereby cooling at least the portion of the synthetic surface.

Clause 16. The system of clause 15, wherein the infill material comprises: rubber infill, ethylene-propylene-diene (EPDM) rubber infill, sand infill, cork infill, mulch infill, coconut shell infill, thermoplastic elastomer (TPE) infill, wood chips, wood infill, textured fibbers, thatch fibers, and a combination thereof.

Therefore, the following is claimed:

1. A self-cooling artificial turf system for moisture retention and evaporation, comprising:

a synthetic surface comprising an elastic sub-layer, wherein the elastic sub-layer comprises a plurality of shock pads configured to interlock to one another, wherein individual ones of the shock pads comprise a top surface, a bottom surface, at least one moisture accumulation region defined by an edge having a height taller than the top surface, a plurality of bottom protrusions on the bottom surface, a plurality of top protrusions defining top surface moisture channels on the top surface, and a plurality of drainage boles connecting at least one of the top surface moisture channels to a respective one of the bottom protrusions, wherein at least one of the drainage holes is nested within a raised edge on the top surface that prohibits the moisture from draining from the at least one moisture accumulation region until a moisture level of the moisture rises higher than the raised edge; and a plurality of synthetic fibers positioned above the synthetic surface in fluid connection with the at least one moisture accumulation region such that the plurality of synthetic fibers are configured to wick moisture from the at least one moisture accumulation region when the moisture is present, wherein at least a portion of the synthetic fibers are hydrophilic such that the plurality of synthetic fibers wick the moisture as it is expelled from the at least one moisture accumulation region, thereby cooling at least a portion of the synthetic surface.

2. The system of claim 1, further comprising infill material positioned in between the plurality of synthetic fibers, the infill material selected from a group consisting of: rubber infill, ethylene-propylene-diene monomer (EPDM) rubber infill, sand infill, cork infill, mulch infill, coconut shell infill, thermoplastic elastomer (TPE) infill, wood chips, wood infill, textured fibbers, thatch fibers, and any combination thereof.

3. The system of claim 1, wherein the synthetic surface comprises a synthetic athletic field surface or a synthetic landscaping surface, and the plurality of synthetic fibers comprise a plurality of synthetic grass fibers.

4. The system of claim 2, wherein the synthetic grass fibers comprise: a plurality of face fibers of a first length; and a plurality of thatch fibers of a second length disposed in rows within the plurality of face fibers and the plurality of thatch fibers.

5. The system of claim 1, wherein the individual ones of the plurality of shock pads are formed of molded open-cell expanded bead polypropylene.

6. A method for moisture retention and evaporation, comprising:

providing a synthetic surface comprising an elastic sub-layer, wherein the elastic sub-layer comprises a plurality of shock pads configured to interlock to one another, wherein individual ones of the shock pads comprise a top surface, a bottom surface, at least one moisture accumulation region defined by an edge having a height taller than the top surface, a plurality of bottom protrusions on the bottom surface, a plurality of top protrusions defining top surface moisture channels on the top surface, and a plurality of drainage holes connecting at least one of the top surface moisture channels to a respective one of the bottom protrusions, wherein at least one of the drainage holes is nested within a raised edge on the top surface that prohibits the moisture from draining from the at least one moisture accumulation region until a moisture level of the moisture rises higher than the raised edge; and positioning a plurality of synthetic fibers above the synthetic surface in fluid connection with the at least one moisture accumulation region such that the plurality of synthetic fibers wick moisture from the at least one moisture accumulation region when the moisture is present, wherein at least a portion of the synthetic fibers are hydrophilic such that the plurality of synthetic fibers wick the moisture as it is expelled from the at least one moisture accumulation region, thereby cooling at least a portion of the synthetic surface.

7. The method of claim 6, further comprising infill material positioned in between the plurality of synthetic fibers, the infill material selected from a group consisting of: rubber infill, ethylene-propylene-diene (EPDM) rubber infill, sand infill, cork infill, mulch infill, coconut shell infill, thermoplastic elastomer (TPE) infill, wood chips, wood infill, textured fibbers, thatch fibers, and any combination thereof.

8. The method of claim 6, wherein the synthetic surface comprises a synthetic athletic field surface or a synthetic landscaping surface, and the plurality of synthetic fibers comprise a plurality of synthetic grass fibers.

9. The method of claim 8, wherein the plurality of synthetic grass fibers comprise: a plurality of face fibers of a first length; and a plurality of thatch fibers of a second length disposed in rows within the plurality of face fibers and the plurality of thatch fibers.

10. The method of claim 6, wherein the individual ones of the plurality of shock pads are formed of molded open-cell expanded bead polypropylene.

11. A self-cooling artificial turf system for moisture retention and evaporation, comprising:

a synthetic surface comprising an elastic sub-layer, wherein the elastic sub-layer comprises a plurality of pads configured to interlock to one another, wherein individual ones of the pads comprise a top surface, a bottom surface, at least one moisture accumulation region defined by an edge having a height taller than the top surface, a plurality of bottom protrusions on the bottom surface, a plurality of top protrusions defining top surface moisture channels on the top surface, and a plurality of drainage holes connecting at least one of the top surface moisture channels to a respective one of the bottom protrusions, wherein at least one of the drainage holes is nested within a raised edge on the top surface that prohibits the moisture from draining from the at least one moisture accumulation region until a moisture level of the moisture rises higher than the raised edge; and a plurality of synthetic fibers positioned above the synthetic surface in fluid connection with the at least one moisture accumulation region such that the plurality of synthetic fibers are configured to wick moisture from the at least one moisture accumulation region when the moisture is present, wherein at least a portion of the synthetic fibers are hydrophilic such that the plurality of synthetic fibers wick the moisture as it is expelled from the at least one moisture accumulation region, thereby cooling at least a portion of the synthetic surface.

12. The self-cooling artificial turf system of claim 11, wherein the plurality of pads are a plurality of shock pads configured to absorb forces upon impact.

13. The self-cooling artificial turf system of claim 11, further comprising infill material positioned in between the plurality of synthetic fibers, the infill material selected from a group consisting of: rubber infill, ethylene-propylene-diene monomer (EPDM) rubber infill, sand infill, cork infill, mulch infill, coconut shell infill, thermoplastic elastomer (TPE) infill, wood chips, wood infill, textured fibbers, thatch fibers, and any combination thereof.

14. The self-cooling artificial turf system of claim 11, wherein the synthetic surface comprises a synthetic athletic field surface or a synthetic landscaping surface, and the plurality of synthetic fibers comprise a plurality of synthetic grass fibers.

15. The self-cooling artificial turf system of claim 14, wherein the synthetic grass fibers comprise: a plurality of face fibers of a first length; and a plurality of thatch fibers of a second length disposed in rows within the plurality of face fibers and the plurality of thatch fibers.

16. The self-cooling artificial turf system of claim 11, wherein the individual ones of the plurality of pads are formed of molded open-cell expanded bead polypropylene.

* * * * *